United States Patent [19]

Chan et al.

[11] Patent Number: 4,958,454

[45] Date of Patent: Sep. 25, 1990

[54] DATA RECORDER

[76] Inventors: Mary K. Chan, 252 N. Crimea St., Ventura, Calif. 93001; Victor Osaka, 11925 Louise Ave., Los Angeles, Calif. 90066

[21] Appl. No.: 380,249

[22] Filed: Jul. 17, 1989

Related U.S. Application Data

[63] Continuation of Ser. No. 117,973, Nov. 9, 1987, abandoned.

[51] Int. Cl.[5] ..... G09F 11/04

[52] U.S. Cl. ..... 40/495; 116/312; 116/318

[58] Field of Search ..... 40/495, 491; 116/311, 116/312, 318, 308, 309

[56] References Cited

U.S. PATENT DOCUMENTS

| | | | |
|---|---|---|---|
| 592,047 | 10/1897 | Cole | 40/495 |
| 1,235,826 | 8/1917 | McKean et al. | 40/495 |
| 1,255,909 | 2/1918 | Monasch | 40/495 |
| 1,367,311 | 2/1921 | Fergusson | 40/495 |
| 1,951,022 | 3/1934 | Iverson | 40/495 |
| 2,252,487 | 8/1941 | Bevill | 40/495 |
| 2,492,891 | 12/1949 | Schall | 40/495 |
| 2,748,514 | 6/1956 | Sulger | 40/495 |
| 2,842,877 | 7/1958 | Stevens | 40/495 |

FOREIGN PATENT DOCUMENTS

| | | | |
|---|---|---|---|
| 805374 | 12/1958 | United Kingdom | 40/495 |

*Primary Examiner*—Kenneth J. Dorner
*Assistant Examiner*—J. Hakomaki
*Attorney, Agent, or Firm*—Marvin E. Jacobs

[57] ABSTRACT

An information recording device containing a body in the form of a thin plate having at least one and preferably three wheel wells rotatably receiving an alpha wheel, numeric wheel and a color coded wheel. The first two wheels are mounted in wheel wells formed in the top surface of the body and have portions extending past one of the side edges of the body positioned under windows in the top cover exposing a single letter or number. The third wheel is mounted in a wheel well formed in the bottom surface of the body—overlapping and underlying the first two wheel wells—and also has a portion extending past the other edge of the body. The third wheel contains color segments viewed by window apertures formed in the body and the bottom cover plate covering the other surface of the third wheel. Each wheel well has a rear hollow recess and a flexure cavity thus formed. A flexure strip bridges the cavity behind the line of circumference of the well. A pawl mounted on the strip extends into the line of the well into engagement with notches formed on the edge of the wheels. Depressing the wheels depresses the strip into a flexure space behind the strip and allows rotation to expose, index and lock the desired letter, number or color of each wheel. On releasing the wheel, the flexure strip returns to lock the wheel in place.

8 Claims, 2 Drawing Sheets

DATA RECORDER

This is a continuation of application Ser. No. 117,973, filed Nov. 9, 1987.

TECHNICAL FIELD

This invention relates to an information recording device and, more particularly, the present invention relates to a multiple disc device for recording the coordinates for locating a car in a parking lot. Optionally, the parking space recorder can contain a chain or ring for retaining keys.

BACKGROUND OF THE INVENTION

As real estate becomes more valuable, planners and developers are providing multi-level parking structures in residential, commercial and industrial developments to maximize utilization of the land required for parking automobiles.

In order to help the automobile user locate his automobile, the structures are usually divided into zones by floor, and portion of floor, usually indicated by color, letter and/or number. However, after several hours of shopping or a business meeting at an office, many times the automobile owner forgets the location of his vehicle in the structure. When he returns to the structure, he faces a frustrating, bewildering and dangerous task of hiking through the traffic lanes of the multi-level structure in search of his automobile.

STATEMENT OF THE PRIOR ART

Simple mechanical devices for recording the floor and space coorinates have previously been provided. The device disclosed in U.S. Pat. No. 3,829,494 (Dillion) utilizes a series of adjacent indicia bearing cylinders, rotatably mounted on a common shaft. The discs must all be the same size and must all be the size of the alphabet bearing disc which must contain 26 characters or be split up into A–K, L–Z, etc., making even more length necessary for the entire cylindrical form. This requirement increases the overall size of the device. The large, cylindrical device does not carry well in a purse or pocket. It readily becomes entangled with the other contents of a purse or pocket and the large, square-edged end does not easily enter the opening of a pant or suit pocket. The knurled edges of the discs are close together and it is sometines difficult to move only one disc at a time. The close disposition of the discs provides a small amount of space above or below the disc for printing the utility of the disc such as floor, zone, etc.

Dillion utilizes a common ridge member 5 to index the six discs 3. The continuous stress of the member 5 can cause fatigue and premature wear, cracking or chipping of the ridge 5. Also the discs 3 bear against each other across the complete face of the sides of the disc again providing wear. When the sides of the disc roughen, they can bind to each other. The discs bear the indicia on the same curved surface as the knurled edges. The constant rubbing or knicking of these surfaces with the finger or finger nail of the user will eventually erase the indicia.

Flat recording devices especially with overlapping flat indicia discs, provide a lower profile form for a car locator device. Such a device is disclosed in my copending design patent application Ser. No. 006,583, filed Jan. 23, 1987, entitled KEY HOLDER PARKING SPACE RECORDER, the disclosure of which is expressly incorporated herein by reference. Laughton (U.S. Pat. No. 2,771,694 discloses a flat powder compact or cigarette case which is personalized with initials by a set of adjacent flat discs indexed by means of a set of curved fingers 26, 27 engaging notches 30 provided on the edges of the discs. Other flat devices for displaying recording data in window openings are disclosed in the following patents:

| PATENT NO. | PATENTEE |
|---|---|
| 1,119,959 | M. K. Higginbottom |
| 1,367,311 | A. R. Fergusson |
| 1,725,976 | F. C. Canode |
| 1,951,022 | V. I. Mason |
| 2,537,598 | B. C. Crapster |
| 2,842,877 | H. A. Stevens |
| 3,297,249 | M. M. Light |
| 3,493,172 | D. N. Bromage |
| 4,026,051 | H. W. Scharrer |
| 4,212,261 | J. Gaetano |

STATEMENT OF THE INVENTION

An improved, flat, low profile, compact recording device is provided in accordance with the invention. The device includes a plurality of flat, overlapping discs. The flat discs receive the indicia on the top surface which is not subject to finger wear. The overlapping discs can receive the same amount of indicia in less thickness than the cylindrical discs which carry the indicia on the outer edge. The discs are each received in precisely formed cylindrical cavities to provide reliable smooth, long-term operation. The indexing of the discs is independent on each disc and is provided by separate, flexible members.

The flat device with curved edges easily enters a pocket or purse and is less likely to become entangled. The housing of the invention contains windows which are widely separated from each other and the flat surface of the housing surrounding adjacent windows is available for imprinting the utility of the window. The recording device of the invention is attrative, reliable and is formed of imprinting the utility of the window. The recording device of the invention is attractive, reliable and is formed of a few parts that are readily assembled. The device is convenient to manufacture at low cost.

Though the description of the invention has featured its use as a parking space locator, the device could also be used to identify an apartment or hotel room number, the time the automobile was initially parked in a timed zone or at a parking meter, the seat and row number in a theater and other like uses.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
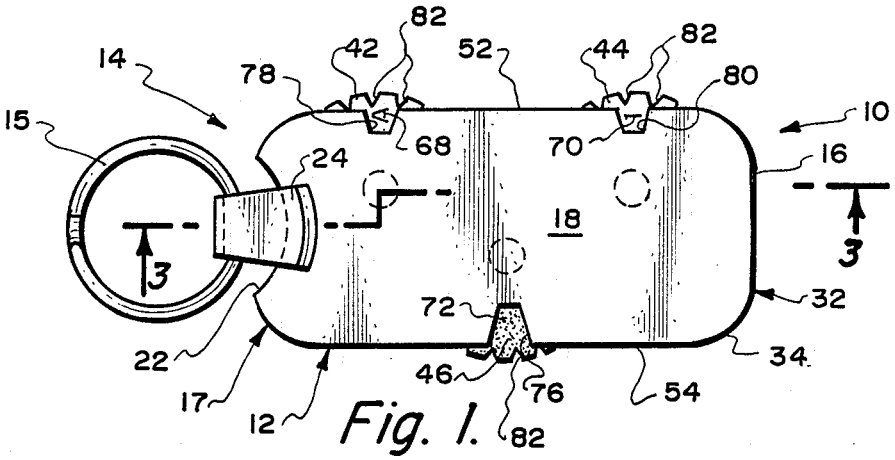
FIG. 1 is a front view in elevation of the data recording device of the invention.
Figure 2:
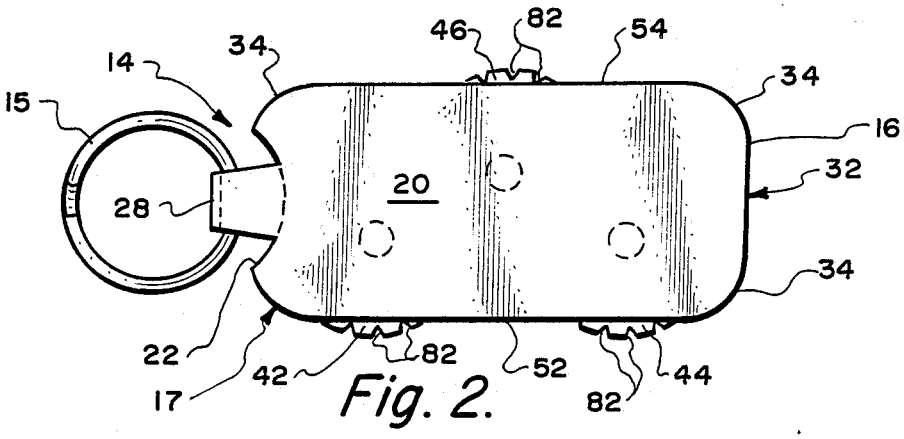
FIG. 2 is a rear view in elevation of the recording device of the invention.
Figure 3:
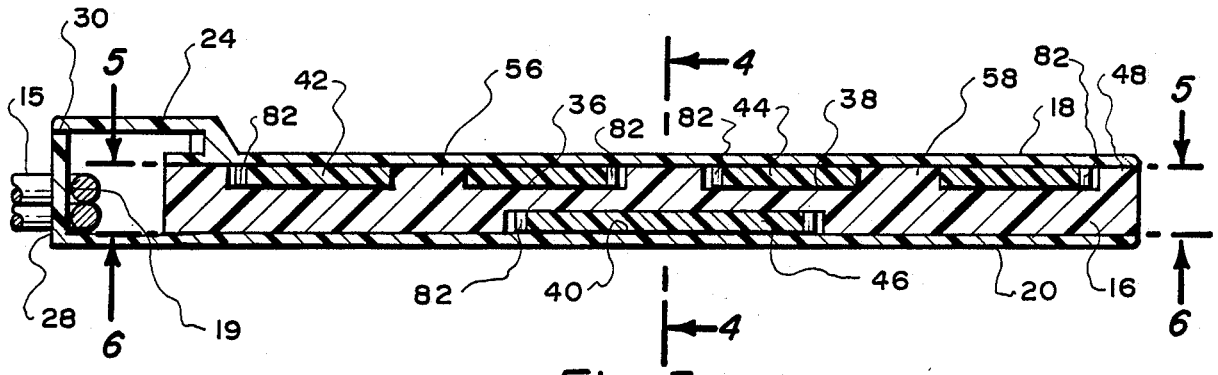
FIG. 3 is a view in section taken along lines 3—3 of FIG. 1.
Figure 4:
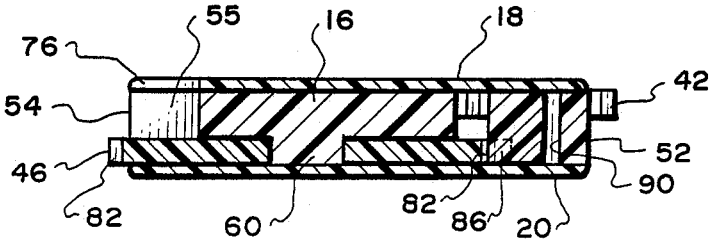
FIG. 4 is a further view in section taken along line 4—4 of FIG. 3.

Referring now to FIGS. 1-4, the data recording device 10 has a recording section 12 and a key ring retainer section 14 carrying a key ring 15. The device 10 is formed section 14 carrying a key ring 15. The device 10 is formed of a body 16 having a top cover 18 and a bottom cover 20. The key ring retaining section 14 may be formed at either end of the device 10.

This section 14 can take the form of an arcuate, recessed cavity 22 formed at a first end 17 of the device. The curvature of the cavity 22 is the same as that of the key ring 15. A flange 24 projects from the top cover. The bottom cover 20 has a projection that matches the profile of the flange 24. The projection of cover 20 has an inwardly facing lip 28 about the thickness of the body 16. The inner surface of the lip may contain an arcuately shaped surface 19 of the same radius of curvature as the arcuate cavity 22 forming a curved holder for the key ring. The edge 30 of the lip is fastened to the inside surface of the top cover projection 24 by suitable means such as adhesive or solvent welding or ultrasonic bonding. The other end 32 of the device 10 can have rounded corners 34 to prevent scratching or catching of material or fabric as the device is placed in a pocket, purse or handbag of the user.

Referring now to FIGS. 3-7, the body 16 is a thin, flat, generally rectangular member having a thickness of less than ½ inch, generally about ¼ inch and a length (with folded back key ring) usually about 3 to 3½ inches and a width of less than 2 inches, usually about 1½ inches. The key ring holding flange is shaped in such a manner as to allow the key ring to fold back flat against the body when placed in pocket or purse. The body contains a plurality of round wheel wells. Preferably the device 10 contains at least two recessed wheel wells 36, 38 for receiving an alpha wheel 42 and a numeric wheel 44. Preferably, the device 10 contains a third recessed wheel well 40 receiving a color disc 46. The wheel wells can be recessed on either or both surfaces of the body 16 but preferably are recessed on section 14 carrying a key ring 15. The device 10 is formed of a body 16 having a top cover 18 and a bottom cover 20. The key ring retaining section 14 may be formed at either end of the device 10.

This section 14 can take the form of an arcuate, recessed cavity 22 formed at a first end 17 of the device. The curvature of the cavity 22 is the same as that of the key ring 15. A flange 24 projects from the top cover. The bottom cover 20 has a projection that matches the profile of the flange 24. The projection of cover 20 has an inwardly facing lip 28 about the thickness of the body 16. The inner surface of the lip may contain an arcuately shaped surface 19 of the same radius of curvature as the arcuate cavity 22 forming a curved holder for the key ring. The edge 30 of the lip is fastened to the inside surface of the top cover projection 24 by suitable means such as adhesive or solvent welding or ultrasonic bonding. The other end 32 of the device 10 can have rounded corners 34 to prevent scratching or catching of material of fabric as the device is placed in a pocket, purse or handbag of the user.

Referring now to FIGS. 3-7, the body 16 is a thin, flat, generally rectangular member having a thickness of less than ½ inch, generally about ¼ inch and a length (with folded back key ring) usually about 3 to 3½ inches and a width of less than 2 inches, usually about 1½ inches. The key ring holding flange is shaped in such a manner as to allow the key ring to fold back flat against the body when placed in pocket or purse. The body contains a plurality of round wheel wells. Preferably the device 10 contains at least two recessed wheel wells 36, 38 for receiving an alpha wheel 42 and a numeric wheel 44. Preferably, the device 10 contains a third recessed wheel well 40 receiving a color disc 46. The wheel wells can be recessed on either or both surfaces of the body 16 but preferably are recessed on opposite surfaces of the body 16 in overlapping relation in order to minimize the length and width of the device 10. Though the wheels need not be of the same thickness or diameter, they can be the same dimension for ease of manufacturing and assembly of the device.

The device 10 is shown with two recessed wheel wells 36, 38 formed in the top surface 48 of the body 16 and a third recessed wheel well 40 formed in the bottom surface of the body 16. The wheel wells 36, 38 are disposed adjacent a first edge 52 of the body 16 while the third wheel well 40 is disposed adjacent the opposite edge 54 of the body 16. Each recessed wheel well and define being annular in shape and defining on the respective top and bottom surfaces a cylindrical hub 56, 58, 60 having a thickness of the wheel for rotatably receiving the central apertures 62, 64, 66 in the wheels 42, 44, 46. The hubs 56, 58 are placed a distance less than a radius of the wheel from the edge 52 so that the wheels 42, 44 extend past the first edge 52 of the body. Similarly, the hub 60 is positioned from the second edge 54 a distance less than the radius of the color wheel 46 such that the wheel extends past the edge 54 of the body 16.

The body 16 is formed with a segment removed along the edge 54 disposed in line with the axis of the hub 60 forming a viewing window 55 for the color segments 72 on the color wheel 46. The top cover 18 has a mating aperture 76 along the second edge 54 of the device and two other window apertures 78, 80 positioned over the alpha and numeric characters 68, 70. The window aperture 55 is exactly double the size of alphabet 78 and number 80 window apertures since there are thirteen color segments on the color wheel 46 making the color segments exactly double the size of the alpha 42 and numeric 44 segments. The windows preferably have non-parallel, slightly diverging sides to better fit the disposition of the characters and segments printed circumferentially on the surfaces of the wheels. The apertures 78, 80 take the shape of a 1/26 segment of a circle. The front edges of the windows are preferably rounded as are the outer edges of the top and bottom covers 18, 20.

The top surfaces of the wheels contain the character or color indicia. The 26 alpha characters 68 are arranged along a circumferential band adjacent the outer edge of the alpha wheel 42. A triangular notch 82 is formed in the edge 84 of the disc centrally opposite each alpha character 68. Similarly,l the numeric wheel 70 contains 25 numbers and one blank space disposed in a circumferential band adjacent the edge 84 of the wheel 44 with a triangular notch 82 formed in the edge 84 centrally opposite each number character 70. The color wheel 46 contains fewer color segments 74 but can contain the same number of notches 82 along the edge 84 if it is of the same size as the other wheels. It will preferably contain 12 color segments of equal width and one blank segment which is left in the natural pigmentation of the molded plastic material.

Figure 5:
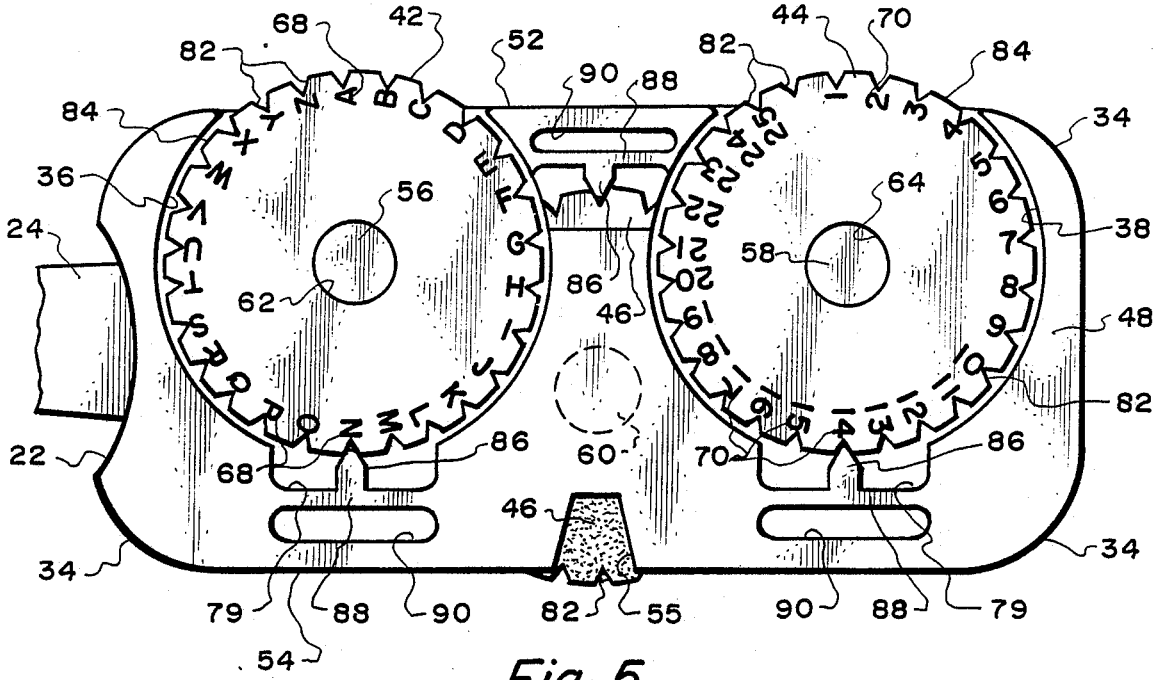
FIG. 5 is a top view in elevation of the body of the recording device taken along line 5—5 of FIG. 3.
Figure 6:
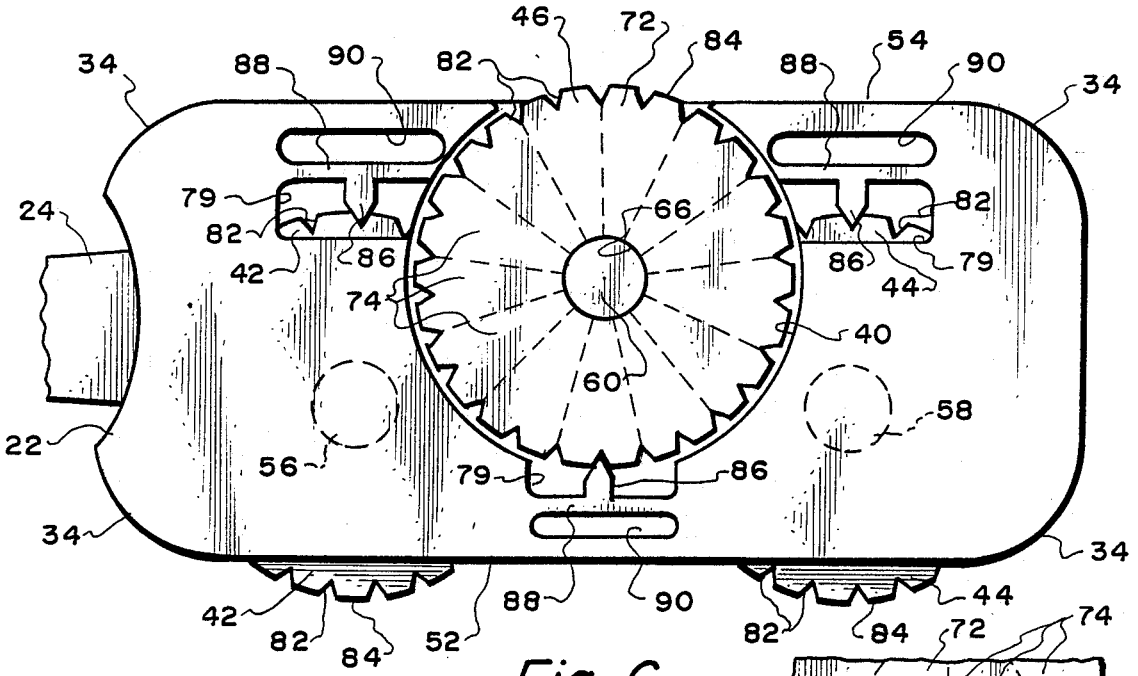
FIG. 6 is a bottom view in elevation of the body of the recording device taken along line 6—6 of FIG. 3.
Figure 7:
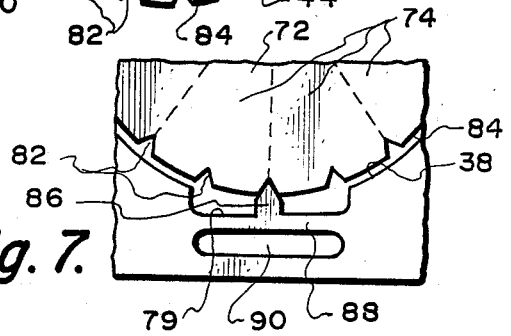

A unique indexing structure for stepped movement and locking of the wheels, 42, 44, 46 is best illustrated in FIGS. 5 and 6. Indexing is provided by a triangular 86 formed on a flexure member in the form of a strip 88. The strip 88 is moled as an integral part of the body 16 and is located within a hollow recess 79 of each wheel well 36, 38, 40 which is in line with each hub 56, 58, 60 and with the center of each aperture 76, 78, 80. A flexure space 90 is provided behind each strip 88 to allow rearward movement of the strip 88.

The pawl 86 is shaped to conform with the notches 82 in the wheels 42, 44, 46 and extends into the wheel well a distance about equal to the depth of the notches. In use, the user presses on a notch 82 on the wheel with his finger or finger nail. The flexure strip 88 will recede slightly into the flexure space 90 to recess the pawl out of the wheel well which allows rotation of the wheel at least one notch to place the pawl in some other notch with the desired indicia exposed in the window aperture. The notches need not be triangular. They can be rounded or rectangular. But they and the pawl are of a symmetric shape allowing for convenient rotation of the wheel in either direction. Slightly rounded triangular pawls and notches appear to provide the best indexing performance.

The device is easily and economically formed of injection molded plastic resin such as polystyrene or ABS.

It is to be realized that only preferred embodiments of the invention have been described and that numerous substitutions, modifications and alterations are permissible without departing from the spirit and scope of the invention as defined in the following claims.

We claim:

1. An information recording device comprising in combination:

a body in the form of a thin plate having a pair of generally flat opposite surfaces, said body having first and second side-by-side spaced apart recessed wheel wells formed in one of said opposite surfaces with portions of said first and second wheel wells being open at a first edge of said body, said body also having a third recessed wheel well formed in the other of said opposite surfaces with a portion of said third wheel well being open at an opposite second edge of said body, said third recessed wheel well having at least a section overlapping at least one of said first and second recessed wheel wells, each of said recessed wheel wells being annular in shape and defining a central hub on said respective one and the other of said opposite surfaces;

first, second and third wheels each carrying a plurality of indicia information on an outer circumferential band and having a central aperture for rotatably mounting said wheel in the corresponding one of said wheel wells on said hub thereof with a portion of said wheel extending from said respective one of said first and opposite second edges of said body at said open portion of said wheel well;

first and second flat covers assembled together with said body therebetween such that said flat covers fit generally flush against said flat opposite surfaces of said body and over said respective wheels disposed in said respective wheel wells, said covers also being disposed over the respective exposed outer circumferential bands of said wheels and each having an aperture of a size limited to view a single indicia on said band of said respective wheel; and means formed on an edge of each wheel and on said body adjacent said respective wheel wells for indexing and locking each of said wheels in a set position with a selected indicia positioned adjacent said respective first and second edges of said body and exposed through said respective apertures of said covers.

2. An information recording device according to claim 1 in which said indexing and locking means includes:

means defining a plurality of notches on the edges of each wheel;

means defining a recess in said body at another portion of each of said recessed wheel wells on a side thereof opposite from said open portion thereof; and means for releasably engaging one of said notches to index and lock each of said respective wheels in the set position.

3. An information recording device according to claim 2 in which said each of said notch engaging means includes:

a flexible strip on said body and extending across a respective one of said recesses in said body outside of the line of circumference of said respective recessed wheel well; and a pawl on said strip adapted to enter one of said notches to index and lock said respective one of said wheels in the set position.

4. An information recording device according to claim 3 wherein said body is composed of a resin material and said flexible strip on said body is composed of the same resin material and is continuous and homogeneous with said body.

5. An information recording device according to claim 4 wherein said pawl is composed of the same resin material as said body and strip and is continuous and homogeneous with said strip.

6. An information recording device according to claim 1 wherein said third recessed wheel well has spaced sections overlapping said respective first and second recessed wheel wells.

7. An information recording device according to claim 1 in which the plate consists essentially of an injection molded plastic resin.

8. An information recording device according to claim 7 in which the resin is one of polystyrene and ABS.

* * * * *